United States Patent [19]

Cadwell, Jr. et al.

[11] Patent Number: 4,678,487

[45] Date of Patent: Jul. 7, 1987

[54] LAMINAR FLOW CLEAN ROOM HAVING IMPROVED FILTER BANK

[75] Inventors: George H. Cadwell, Jr., Blounts Creek; Clarence B. Pittman, Pinetown; Cecil W. Bowers, Washington, all of N.C.

[73] Assignee: Flanders Filters, Inc., Washington, N.C.

[21] Appl. No.: 733,972

[22] Filed: May 14, 1985

[51] Int. Cl.[4] ..... B01D 46/00

[52] U.S. Cl. ..... 55/385 A; 52/484; 52/665; 52/666; 55/483; 55/484; 55/494; 55/502; 55/DIG. 29

[58] Field of Search ..... 55/385 A, 483, 484, 55/494, 502, DIG. 29; 52/484, 664, 665, 666, 669

[56] References Cited

U.S. PATENT DOCUMENTS

| | | | |
|---|---|---|---|
| 407,376 | 7/1889 | Smith | 52/484 X |
| 2,252,724 | 8/1941 | Myers | 55/483 X |
| 2,753,440 | 7/1956 | Wakefield . | |
| 3,013,644 | 12/1961 | Smith et al. | 52/665 X |
| 3,232,021 | 2/1966 | Wilson | 52/484 X |
| 3,241,280 | 3/1966 | Kreuzer | 52/484 X |
| 3,321,877 | 5/1967 | Alexieff . | |
| 3,471,981 | 10/1969 | Segil et al. . | |
| 3,486,311 | 12/1969 | Allan, Jr. | 55/385 A X |
| 3,491,500 | 1/1970 | Fischer . | |
| 3,707,046 | 12/1972 | De Baun | 55/484 X |
| 3,742,674 | 7/1973 | Lang | 52/666 |
| 3,785,110 | 1/1974 | Galloway et al. | 52/484 X |
| 3,791,089 | 2/1974 | Alderman | 52/484 |
| 3,835,614 | 9/1974 | Downing, Jr. | 52/666 |
| 3,848,385 | 11/1974 | Thompson | 52/484 X |
| 3,986,850 | 10/1976 | Wilcox | 55/484 X |
| 4,047,348 | 9/1977 | McSweeney | 52/484 |
| 4,229,913 | 10/1980 | Corrigan | 52/484 X |
| 4,233,044 | 11/1980 | Allan | 55/484 X |
| 4,511,380 | 4/1985 | Fetter | 55/494 X |
| 4,545,793 | 10/1985 | Shuler | 55/484 X |
| 4,555,255 | 11/1985 | Kissel | 55/484 X |

OTHER PUBLICATIONS

The Condensed Chemical Dictionary, 10th ed., Van Nostrand Reinhold Co., New York, N.Y., 1981, pp. 921–922.

*Primary Examiner*—Kathleen J. Prunner

*Attorney, Agent, or Firm*—Bell, Seltzer, Park & Gibson

[57] ABSTRACT

A clean room having provision for supplying filtered air vertically therethrough under substantially laminar flow conditions is disclosed, and which includes a filter bank comprising a supporting latticework composed of a plurality of interconnected members which define rectangular open areas, and a plurality of high efficiency air filters positioned on the supporting latticework. The interconnected members of the latticework include a plurality of parallel, laterally spaced apart lengthwise members, and a plurality of cross members extending laterally between the lengthwise members, and with the ends of the cross members abutting an intermediate length of the lengthwise members. In one embodiment, each of the members of the latticework includes an integral, upwardly extending post, which is adapted to be engaged by a retainer for interconnecting the members, and also by a support bracket for supporting the latticework from an overhead ceiling. The members preferably have a generally V-shaped outline in cross section with the angular extent of the V-shaped outline being adapted to provide a substantially laminar flow therealong, and so as eliminate any substantial turbulence below the members of the latticework. Also, a sealant is disposed between the filters and supporting latticework, which comprises an essentially non-volatile and non-hardening polysiloxane gum.

16 Claims, 25 Drawing Figures

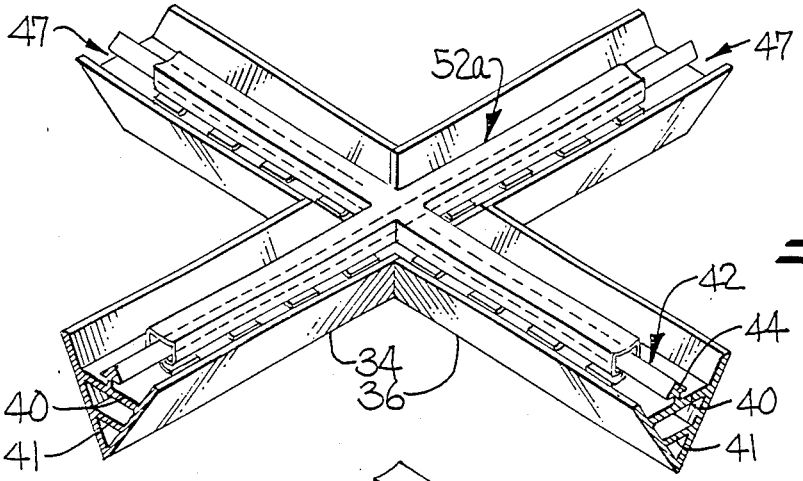
Fig-5
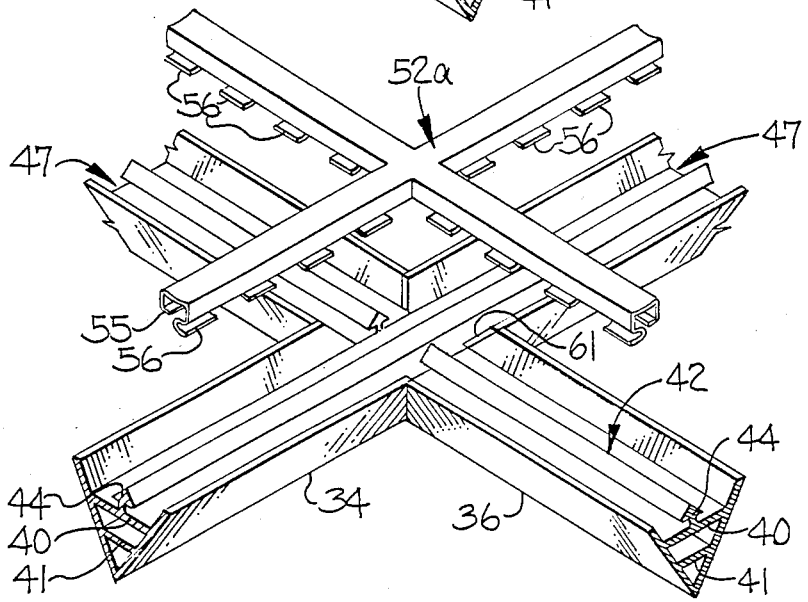
Fig-6
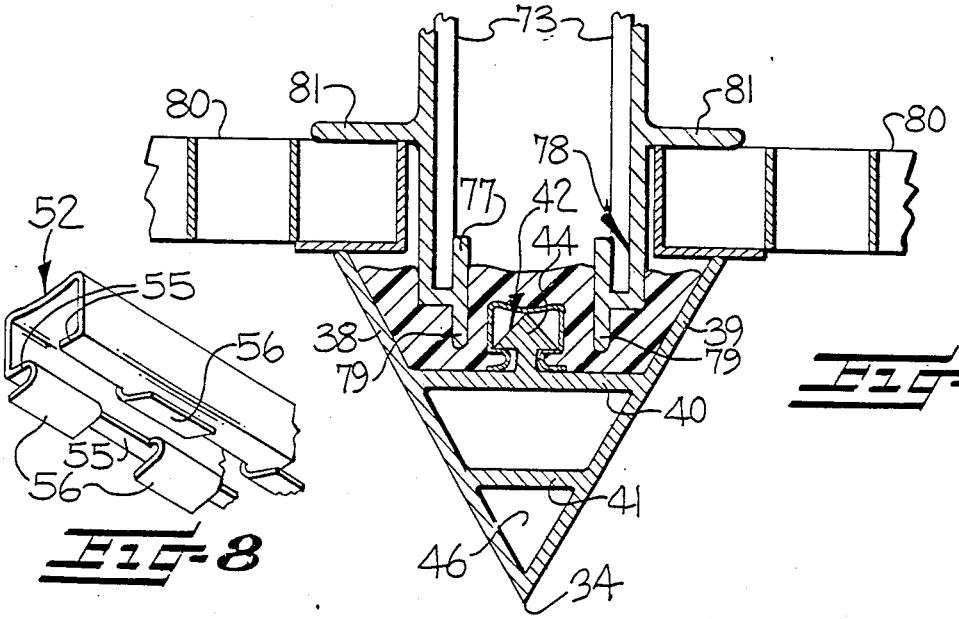
Fig-7
Fig-8

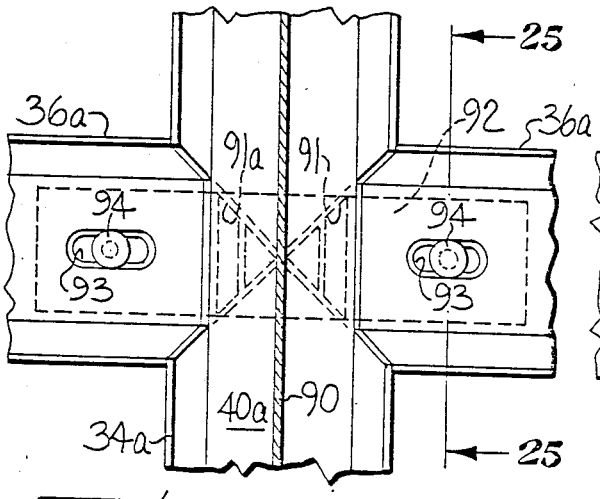
FIG-22
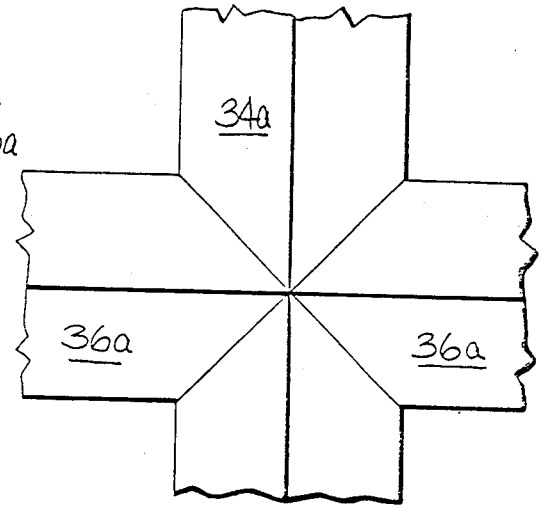
FIG-23
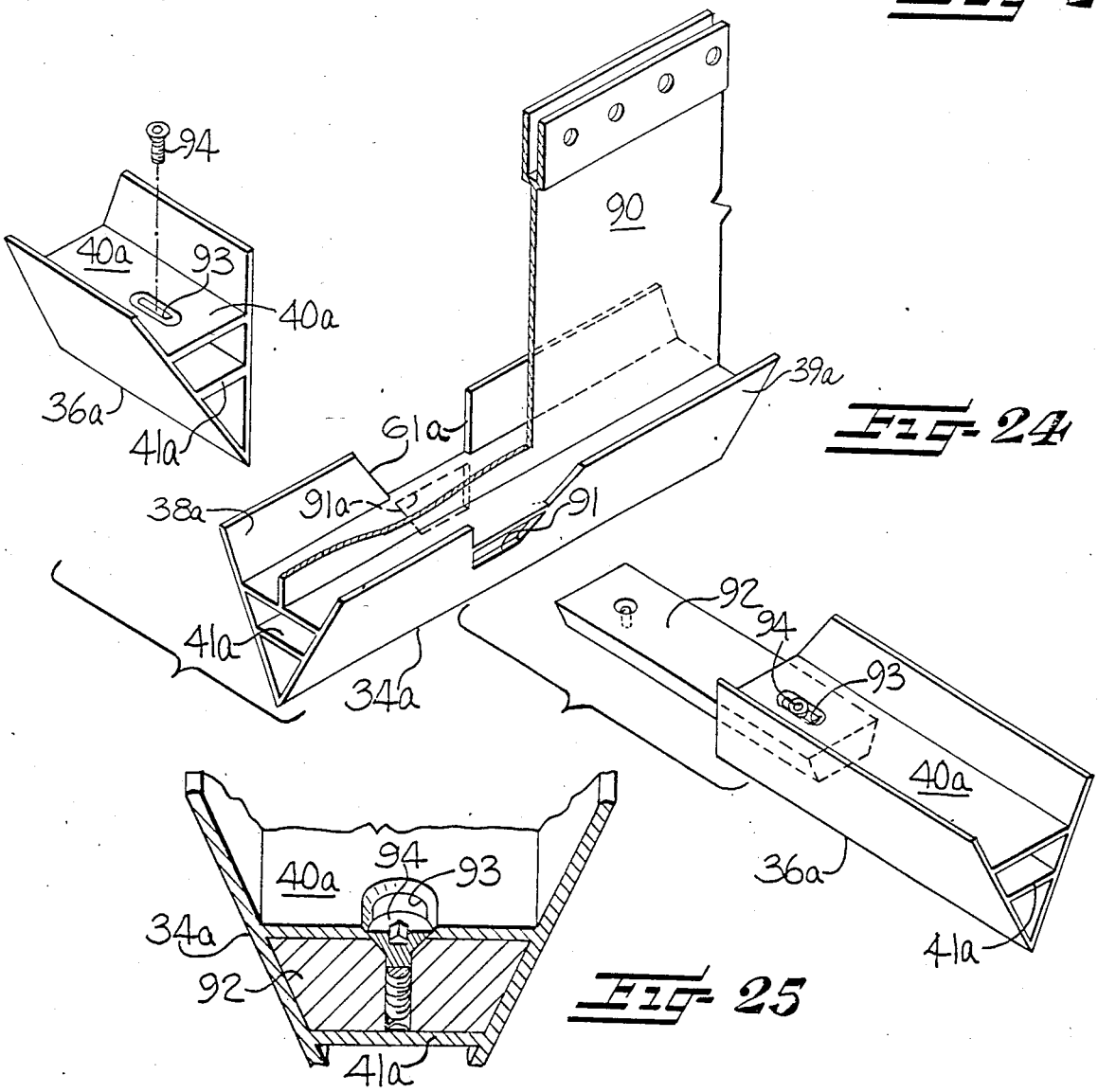
FIG-24
FIG-25

LAMINAR FLOW CLEAN ROOM HAVING IMPROVED FILTER BANK

The present invention relates to a clean room having provision for supplying filtered air to a work area under substantially laminar flow conditions.

The need for a controlled, contaminant-free work area is well recognized in industry wherever precision manufacturing and assembly operations are conducted, and several clean room designs have been developed for this purpose. In one such present design, the clean room comprises a room-like enclosure having a filter bank suspended from and overlying the entire ceiling. The filter bank includes a number of individual high efficiency filters supported on a rectangular latticework, and a blower introduces air under pressure into the open plenum chamber formed between the filter bank and ceiling. The air then passes downwardly through the filters and vertically through the room. Appropriate ducts are provided in or adjacent the floor for conveying the air back to the blower for recirculation.

To seal the filters to the latticework, a gasket of neoprene rubber or other similar material is commonly provided, which is secured to the front periphery of the filter frame, and which is designed to contact an inwardly turned peripheral flange on the latticework. A suitable clamping mechanism is then provided to press the filter frame and its front gasket against the flange to compress the gasket and thereby prevent leakage of air around the outside of the filter. Such gasket seals have proven to be unsatisfactory in many applications however, since the gasket material often deteriorates and unfiltered air leaks may develop across the gasket, or at the butt end joint of the gasket.

In U.S. Pat. No. 3,486,311 to Allan, and U.S. Pat. No. 3,986,850 to Wilcox, both of which are commonly owned with the present invention, there is disclosed a filter bank assembly for a vertical laminar flow clean room, which comprises a horizontally suspended filter supporting latticework composed of corner connectors and a plurality of U-shaped channels extending between the connectors so as to define a plurality of rectangular open areas. A sealing fluid of relatively high consistency is disposed in the channels and connectors, and a high efficiency particulate air (HEPA) filter is adapted to be supported over each rectangular open area of the latticework. Each filter includes a peripheral skirt adapted to be received in the U-shaped channel and the connector so as to form a continuous peripheral seal with the fluid. In commercial practice, the fluid has comprised a silicone base grease having a viscosity of about 30,000 centipoise, although a silicone based grease having a viscosity up to about 150,000 centipoise has been suggested for this use, note the above referenced patent to Wilcox.

While the filter bank construction as described in the above referenced Allan and Wilcox patents has met with substantial commercial success, the initial fabrication of the latticework has been found to be a relatively difficult and time consuming operation. In particular, the presently employed procedure for assembling the filter supporting latticework involves suspending tie rods from the ceiling, attaching an X-shaped connector to each tie rod, leveling the individual connectors so that they are all co-planar, and then securing U-shaped channels between the connectors. This assembly is done one connector at a time, and requires caulking and riveting each channel to its associated connector, while insuring that the proper distance is maintained between the connectors. Such measurement is complicated by the fact that the connectors, which are mounted at the ends of the tie rods, freely swing. Copending U.S. patent application Ser. No. 451,198 discloses certain improvements in the latticework construction which alleviates much of the difficulty, but it is recognized that further improvement is desirable.

The fluid sealing structure of the above patents also represents a vast improvement over the previously employed gasket seals, and has met with a great deal of commercial success since a near perfect and nondeteriorating seal is achieved under normal operating conditions. However, under certain unusual operating conditions, the fluid sealant tends to dry out, which can in time result in cracks and leaks, and further, the drying out (or out-gassing) may result in undesirable gases being introduced into the filtered airstream.

A further and long recognized problem associated with clean rooms of the described type is the fact that dust or dirt particles which are periodically introduced into one area of the room often migrate to distant areas of the room where they contaminate sensitive products or materials. Thus, for example, when persons or raw materials enter the room through a door, the particle count will often increase at a distant location in the room. The cause for this migration of particles has not been understood, since one would expect that under laminar flow conditions the particles introduced into the room would move directly downwardly, and be removed through the exhaust duct in or adjacent the floor.

In accordance with the present invention, the cause of the migration of dust or dirt particles through the clean room has been discovered, and a novel structure for the filter bank has been developed which substantially alleviates the problem. More particularly, the present invention involves the discovery that migration of the particles occurs within the zone of turbulence formed for a short distance below each of the connectors and channels of the supporting latticework of the filter bank, and that this turbulence tends to attract and entrain the particles and to move the entrained particles laterally in the length direction of the channels to distant areas of the room, where they are eventually released and move downwardly. The present invention also involves the further discovery that by substantially reducing or eliminating the zone of turbulence beneath the connectors and channels of the supporting latticework, the problem of migration of particles is significantly alleviated.

It is accordingly an object of the present invention to provide a clean room having a supporting latticework for a filter bank which is of simple and inexpensive construction, and which is relatively easy to assemble in the clean room.

It is also an object of the present invention to provide a clean room of the described type which substantially alleviates the problem of particle migration, so that distant areas of the room are unaffected when particles are introduced in one area of the room.

It is still another object of the present invention to provide a clean room of the described type and having a sealant which is adapted to provide an essentially leak proof, non-deteriorating, and non-drying seal between the filters and the supporting latticework.

These and other objects and advantages are achieved in the embodiments of the invention described herein by the provision of a clean room which comprises an enclosure including a top wall, a bottom wall, and bounding side walls, a filter bank positioned parallel to and spaced below the top wall, with the filter bank comprising a supporting latticework defining a plurality of rectangular open areas, and a plurality of high efficiency air filters sealably positioned on the supporting latticework with one of the filters covering each of the open areas. Blower means is provided for introducing air above each of the filters of the filter bank such that the air flows downwardly through the filters at a predetermined flow rate. Further, and in accordance with the preferred embodiment of the present invention, the supporting latticework is made up of a plurality of parallel, laterally spaced apart lengthwise members, and a plurality of cross members extending laterally between the lengthwise members, with the lengthwise and cross members each comprising a pair of outer side walls and an internal plate extending horizontally between the side walls to define an upwardly open receptacle. Also, the ends of said cross members abut the lengthwise members at a location intermediate the ends thereof to define a right angled interconnection therebetween, and each such interconnection includes a cut-out section in the side wall of the lengthwise member which extends downwardly to the level of the associated plate and laterally a distance conforming to the separation of the adjacent portion of the side walls of the associated cross member. The plates of the lengthwise and cross members are thus coextensive, and the sealant is positioned upon said coextensive plates continuously about the periphery of each open area. In addition, each of the interconnections further including retainer means interconnecting the end of the cross member and the associated lengthwise member.

In a preferred embodiment, the interconnected members of the latticework have generally V-shaped outline in cross section, with the angular extent of the V-shaped outline being such as to provide a substantially laminar flow therealong for the particular value of the air flow rate, and so as to substantially eliminate turbulence below the members of the latticework. By the substantial elimination of the turbulence, the tendency of the particles to be moved laterally through the room is significantly alle- viated.

In the illustrated specific embodiments, each filter includes a peripheral flange or skirt which has a continuous cross sectional outline corresponding to that of the associated open area, and so that the forward edge portion of the peripheral flange is positioned within the upper portion of the members and sealably embedded in the sealant. In addition, the sealant comprises an essentially non-volatile and non-hardening moldable gum-like plastic material having a consistency substantially the same as modeling clay, which has been found to provide an essentially leak proof, non-deteriorating and non-drying seal between the filters and the supporting latticework.

Some of the objects and advantages of the invention having been stated, others will appear as the description proceeds, when taken in connection with the accompanying drawings, in which:

FIG. 5 is a fragmentary perspective view of one of the generally X-shaped interconnections of the latticework;

FIG. 6 is an exploded view of the interconnection shown in FIG. 5;

FIG. 7 is a cross sectional view of one of the members of the latticework of the filter bank, together with the adjacent portions of the filter frames and protective grilles;

FIG. 8 is a fragmentary perspective view of a snap-on retainer for joining the members of the latticework;

FIG. 22 is a fragmentary and sectioned top plan view of one of the generally X-shaped interconnections of the latticework of FIG. 20;

FIG. 23 is a bottom plan view of the interconnection shown in FIG. 22;

FIG. 24 is an exploded perspective view of the interconnection shown in FIG. 22;

FIG. 25 is a perspective sectional view taken substantially along the line 25—25 of FIG. 22;

Figure 1:
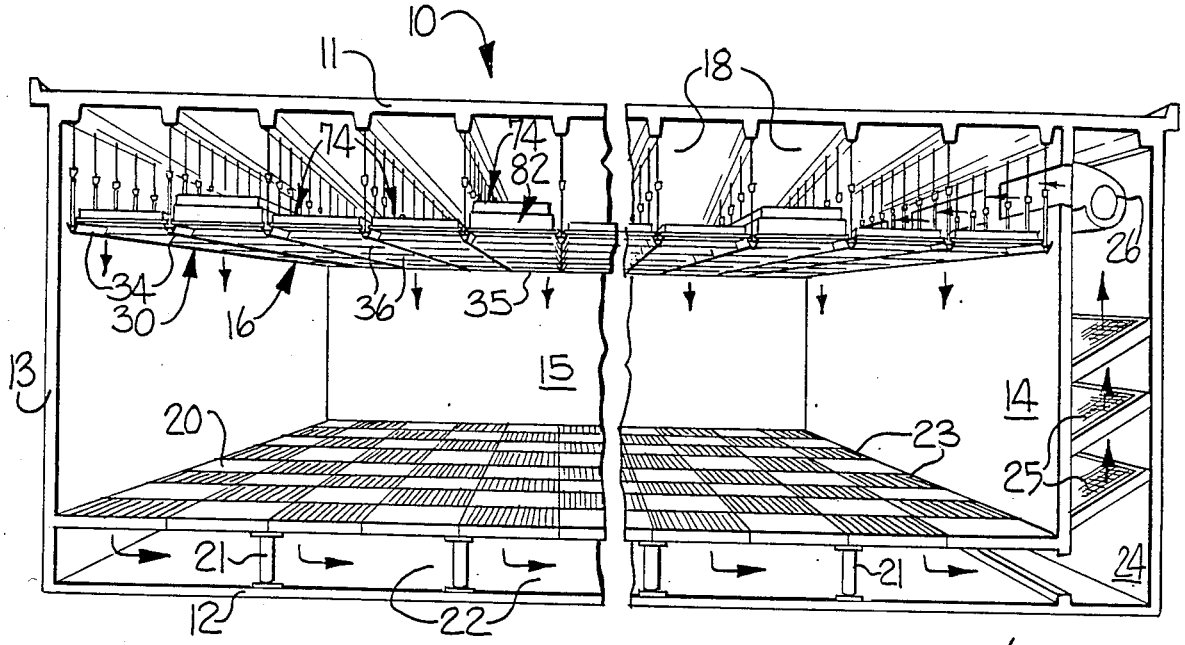
FIG. 1 is a sectioned side elevation view of a clean room which embodies the features of the present invention.
Figure 2:
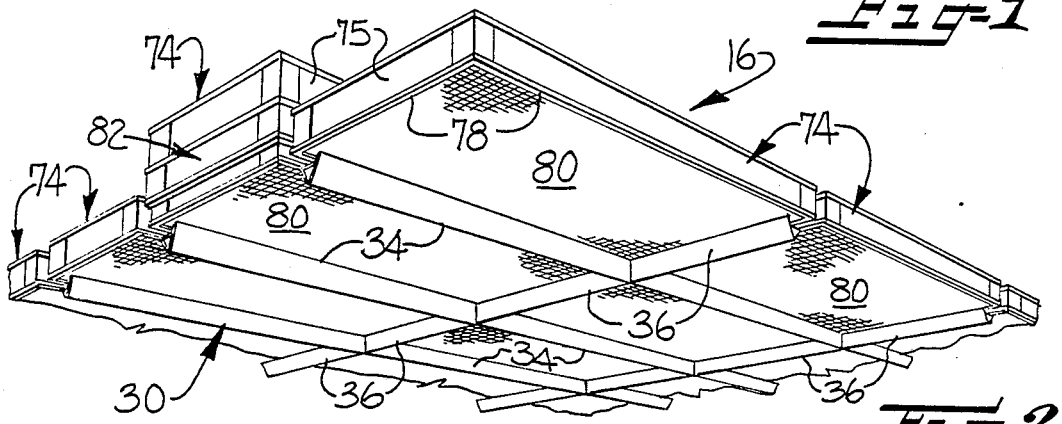
FIG. 2 is a fragmentary perspective view of the filter bank employed in the clean room shown in FIG. 1.
Figure 3:
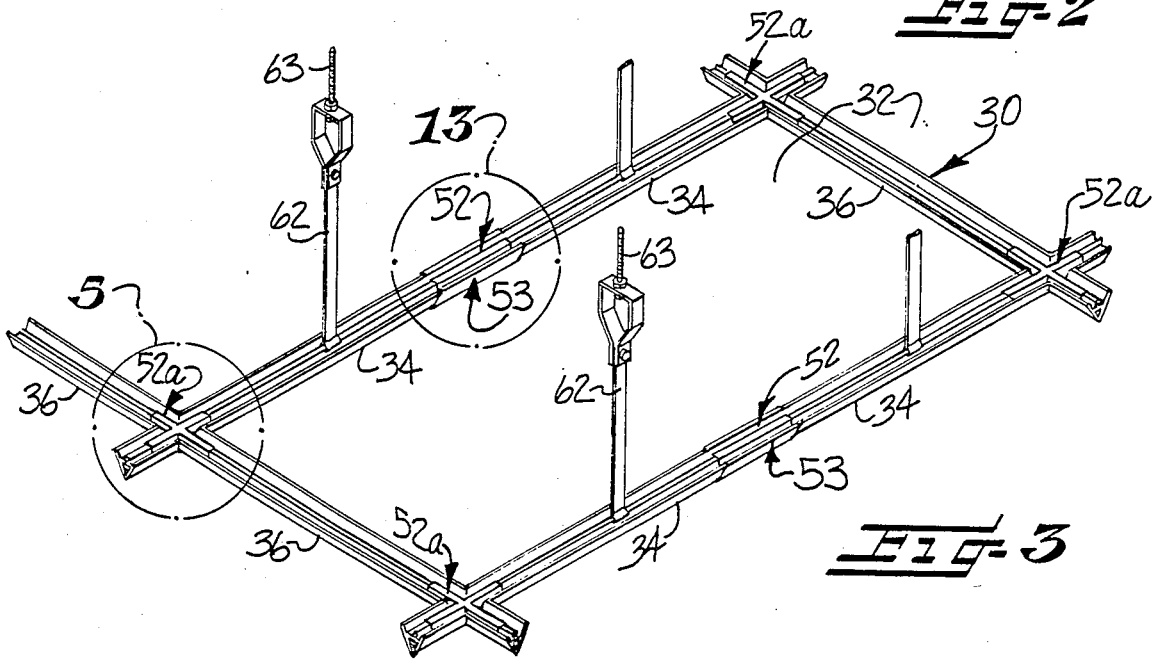
FIG. 3 is a fragmentary perspective view of a portion of the supporting latticework of the filter bank.

Referring more specifically to the drawings, FIG. 1 illustrates a clean room 10 embodying the features of the present invention. As illustrated, the clean room comprises an enclosure which includes a top wall 11, a bottom wall 12, two bounding side walls 13, 14, and a bounding end wall 15 (the opposite bounding end wall not being shown). A horizontally disposed filter bank 16 is positioned within the enclosure parallel to and spaced from the top wall 11 to define an open air supply plenum 18 therebetween. A raised floor 20 is mounted on suitable pedestals 21 above the bottom wall 12 to define a return air plenum 22, the floor 20 including a number of perforated panels 23 for permitting air to pass therethrough. The return air plenum 22 communicates with a vertical duct 24 containing a number of prefilters 25, and the vertical duct in turn communicates with the air handling unit 26 for recirculating the air into the air supply plenum 18. Typically, the air handling unit comprises a number of blowers 26, and a heating or air conditioning apparatus. Thus in use, the air delivered to the air supply plenum 18 by the air handling unit 26 passes downwardly through the filter bank 16 such that substantially all contaminants are removed immediately before the air enters the room. The air then passes vertically downwardly through the room under substantially laminar flow conditions, and through the floor 20 to the return air plenum 22. The returning air passes through the prefilters 25 where any relatively large particles in the airstream are removed, and through the blowers 26 to the air supply plenum 18.

The filter bank 16 has an area which is substantially coextensive with the area of the top wall 11, and comprises a horizontally disposed supporting latticework 30 which defines a plurality of rectangular open areas 32. In the embodiment of FIGS. 1–19, the latticework 30 comprises a plurality of parallel, laterally spaced apart lengthwise members 34 which are parallel to the side walls 13 and 14, an elongate end wall member 35 along each of the two end walls 15 of the room and thus extending perpendicular to the lengthwise members 34, and a plurality of relatively short cross members 36 extending laterally between the lengthwise members 34 and parallel to the end wall members 35. The lengthwise members 34 and two end wall members 35 are preferably continuous along the full length or width of the clean room, although they may comprise a number of sections which are joined end to end by an interconnection as described below.

Figure 11:
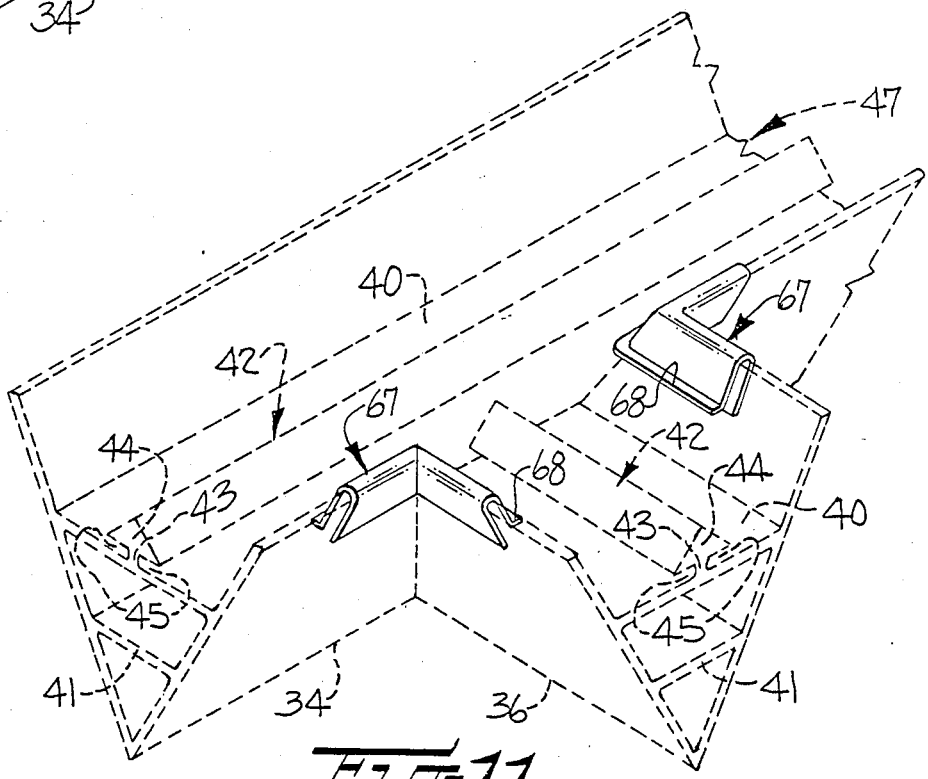
FIG. 11 is a fragmentary perspective view of a T-shaped interconnection, and specifically illustrating edge clips for maintaining the interconnection.

The members 34, 35, and 36 have a like cross sectional outline, as best seen in FIGS. 7 and 11. In particular, each member includes a pair of outer side walls 38, 39 which are disposed in a V-shaped arrangement, an upper internal plate 40 extending horizontally between the side walls, and a lower internal plate 41 disposed parallel to and below the plate 40. Thus each member may be said to have the general form of an inverted A in cross section. The members also include an integral post 42 extending upwardly a relatively short distance from a medial portion of the plate 40 and longitudinally along the length of the member. The post 42 includes an upright leg 43 and an enlarged triangular or wedge shaped portion 44 in cross section positioned at the upper end of the upright leg 43, and so as to define outwardly facing slots 45 on opposite sides of the post and which are positioned between the upper surface of the internal plate 40 and the wedge shaped portion 44. The triangular area 46 below the lower internal plate 41 defines a hollow receptacle which extends along the length of the member, and which is adapted to serve as an electrical wire chase or the like, if desired. The area above the plate 40 defines an upwardly open receptacle 47 which is adapted to receive a sealant 48 as further described below. In addition, the open space between the upper plate 40 and lower plate 41 is adapted to receive an internal retainer 49 as further described below. The members 34, 35, 36 are preferably fabricated from a suitable metal or plastic material, and they may be extruded into the described configuration. As a specific example, the members may comprise extruded and anodized aluminum.

Figure 12:
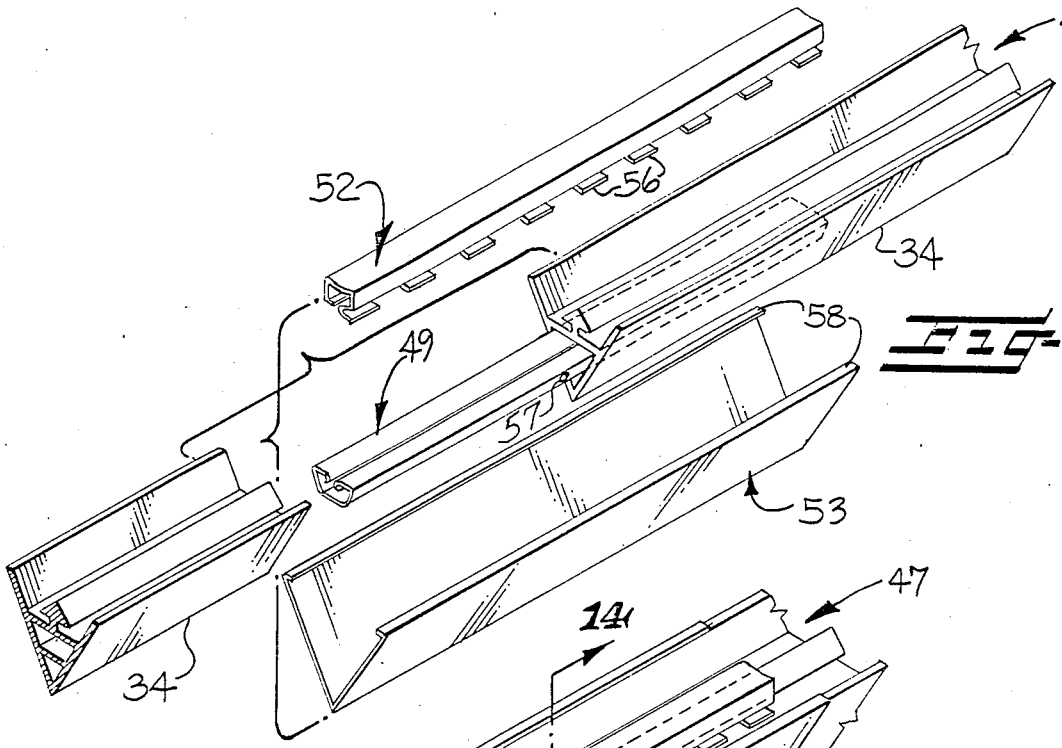
FIG. 12 is an exploded perspective view of an end to end interconnection of the members of the latticework.
Figure 13:
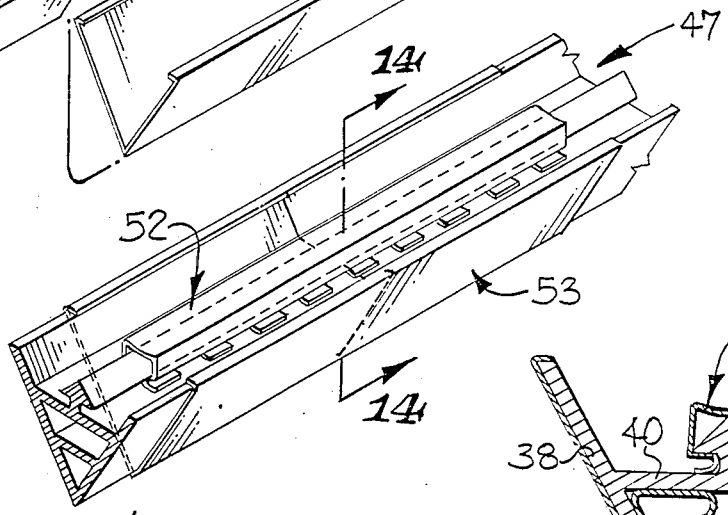
FIG. 13 is a perspective view of an assembled end to end interconnection.
Figure 14:
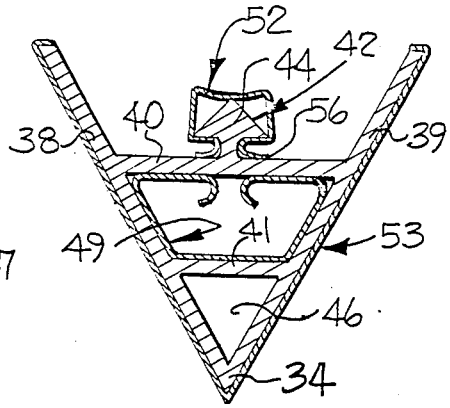
FIG. 14 is a sectional view taken substantially along the line 14—14 of FIG. 13.

The lengthwise members 34 are adapted to be joined end to end by means of an interconnection as best seen in FIGS. 12–14. This interconnection includes an elongate snap-on external retainer 52, an internal retainer 49, and an outer cover 53. The snap-on retainer 52 is formed of sheet metal and is shaped to be matingly received on the wedge shaped portions 44 of the posts 42 of the aligned members 34. More particularly, the retainer 52 has a generally rectangular enclosed outline in cross section, and the bottom wall is longitudinally split to form two separated sections 55, note FIG. 8, with the sections including integral, reversely bent tabs 56 which are dimensioned so as to be adapted to be closely received in the slots 45 of the posts 42. To effect assembly, the retainer is pressed downwardly onto the posts of the aligned members 34, and so that the tabs engage the wedge shaped portions 44 to cause the bottom wall sections to spring apart and receive the post therewithin. The tabs will then lock within the slots 45 as seen for example in FIG. 14, so that the retainer 52 surrounds and grippingly engages the posts.

The internal retainer 49 also is formed of a sheet metal material, and its cross section is configured to closely match the outline of the space between the plates 40 and 41. To effect its assembly between the members 34, one end of the retainer 49 is inserted into the end of one of the members 34 as seen in FIG. 12, and the other member 34 may then be slipped onto the remaining portion of the splice. To prevent the retainer 49 from moving further into the initial member during the assembly of the second member, the retainer 49 may be provided with an aperture 57 in the side wall, which permits the technician to insert a tool, such as a screwdriver, and thereby prevent further sliding of the retainer into the initial member.

The cover 53 is in the form of a V-shaped sleeve which is adapted to underlie the end portions of the abutting members 34 to further reinforce the interconnection. The cover has in-turned flanges 58 along the upper edges, which permit the cover to be assembled by pressing the cover onto the aligned members from below so that the flanges snap over and lock behind the upper edges of the side walls 38, 39 of the members.

Figure 9:
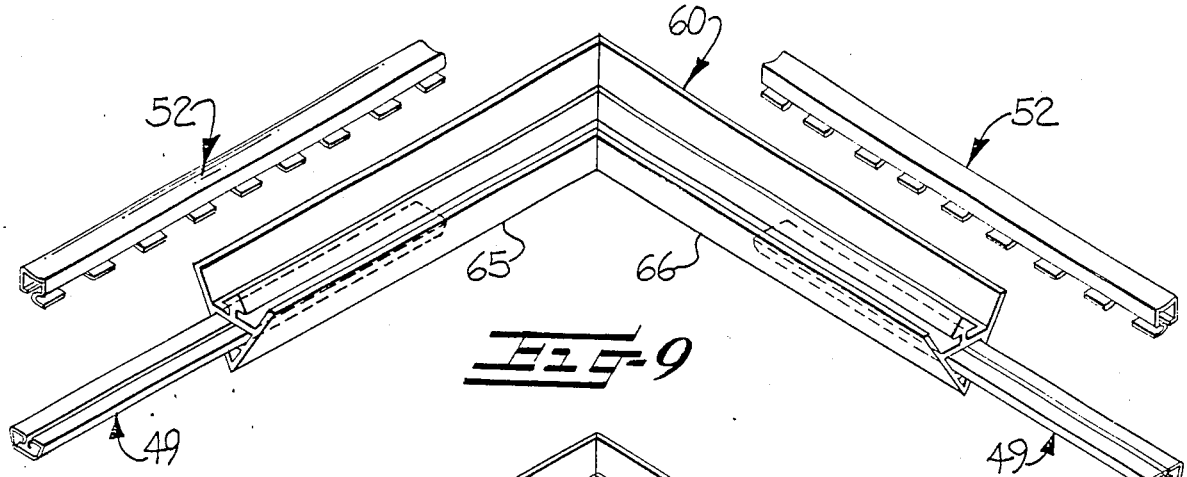
FIG. 9 is an exploded perspective view of one of the mitered corner interconnections of the latticework.
Figure 10:
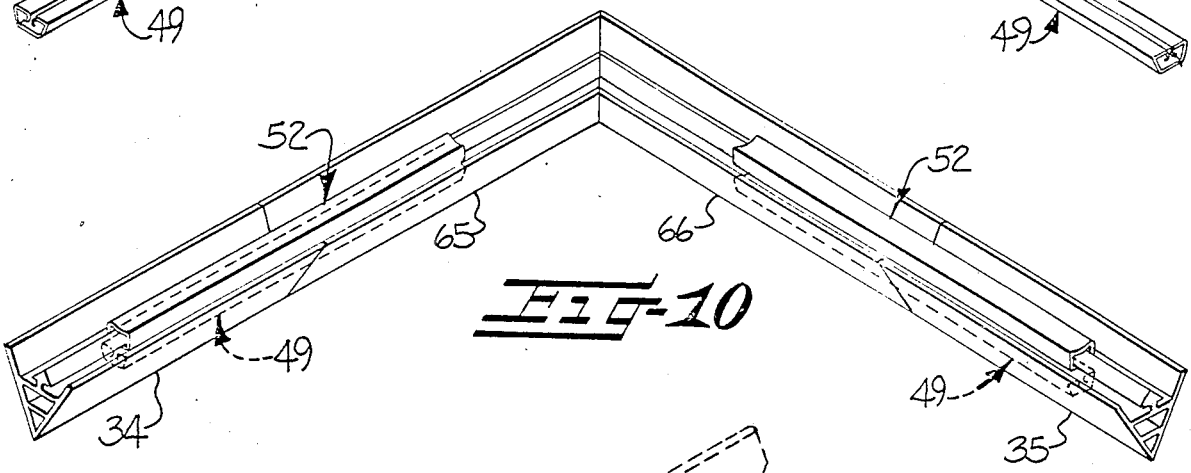
FIG. 10 is a perspective view of an assembled corner interconnection.
Figure 15:
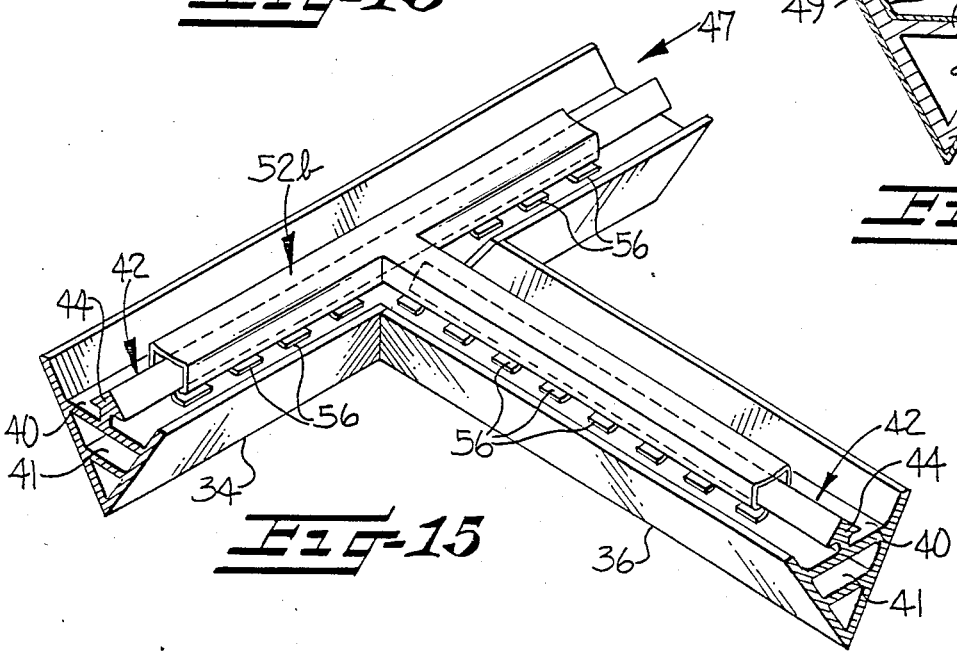
FIG. 15 is a perspective view of a T-shaped interconnection.
Figure 16:
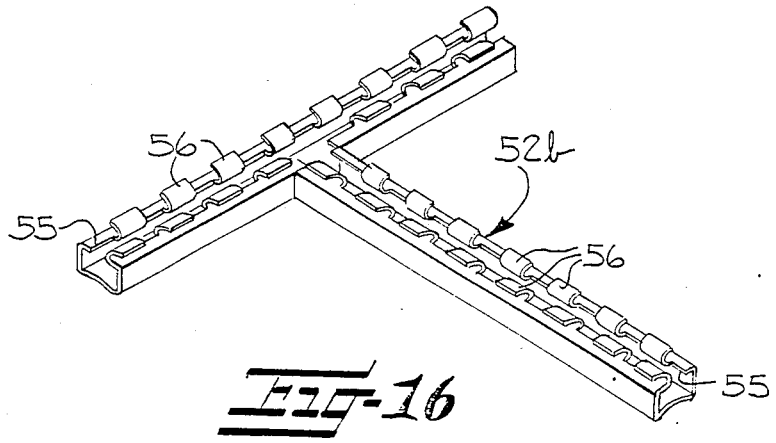
FIG. 16 is a perspective view of a snap-on retainer used in the T-shaped interconnection of FIG. 15.

The interconnected lengthwise and cross members will be seen to define generally X-shaped interconnections within the interior of the latticework (note FIG. 5), and T-shaped interconnections along the side walls (note FIG. 15). It will also be seen that each end of each cross member 36 abuts the associated lengthwise member 34 at a location intermediate its ends, and that the ends of the two cross members are aligned on opposite sides of the lengthwise member at the generally X-shaped interior interconnections. The lengthwise members 34 and the two end wall members 35 are joined in each of the four corners of the room by a mitered L-shaped interconnection 60 as seen in FIGS. 9 and 10, and the remaining ends of the lengthwise members 34 are joined to an intermediate portion of the length of the end wall members 35 by a T-shaped interconnection similar to that shown in FIG. 15.

Figure 4:
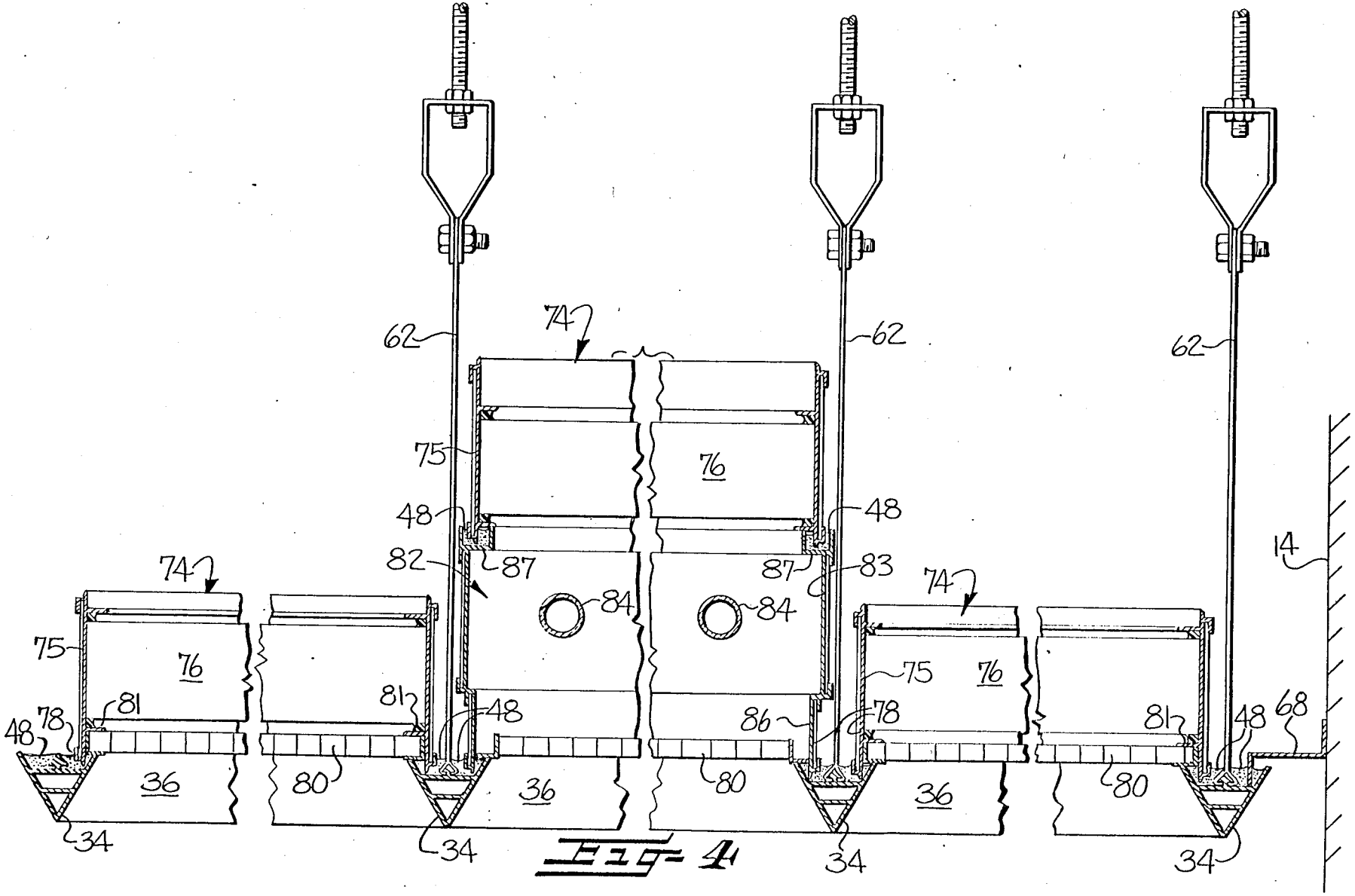
FIG. 4 is a sectional side elevation view of the filter bank.

At each of the interconnections between the lengthwise and cross members, there is provided a cut-out section 61 in the side wall of the lengthwise member (note FIGS. 5, 6, and 11) which extends downwardly to the level of the associated plate 40 and laterally a distance conforming to the separation of the adjacent portion of the side walls of the associated cross member 36. Thus the plates 40 of the lengthwise and cross members are coextensive. Also, the sealant 48 is positioned upon the coextensive plates continuously about the periphery of each open area of the latticework as seen in FIG. 4.

Each such interconnection further comprises retainer means interconnecting the cross member 36 and the associated lengthwise member 34. At the generally X-shaped interconnections as best seen in FIGS. 5 and 6, a generally X-shaped retainer 52*a* is provided which has a cross section corresponding to that of the above described retainer 52, and which is adapted to be snapped onto the posts of the associated members 34 and 36. At the T-shaped interconnections as seen in FIG. 15, the retainer 52*b* has a T-shaped outline, and the retainer 52*b* is adapted to be snapped onto upon the posts 42 of the two members in the manner described above.

The L-shaped interconnections 60 at each of the four corners of the room each comprise two relatively short sections 65, 66 which conform to the cross sectional configuration of the members 34, 35, and 36, and which are mitered and fixedly interconnected by welding or the like. Each L-shaped interconnection 60 is joined to abutting members 34 and 35, using a retainer 52 and internal splice 49 in the manner described above.

FIG. 11 illustrates a pair of right angled clips 67, which may be utilized in the manner illustrated to reinforce a T-shaped interconnection. The clips 67 have a U-shaped outline in cross section which is slipped over the side walls 38, 39 of the members, and the inside leg of each clip includes a horizontal lip 68 for facilitating its assembly onto the side walls.

Figure 17:
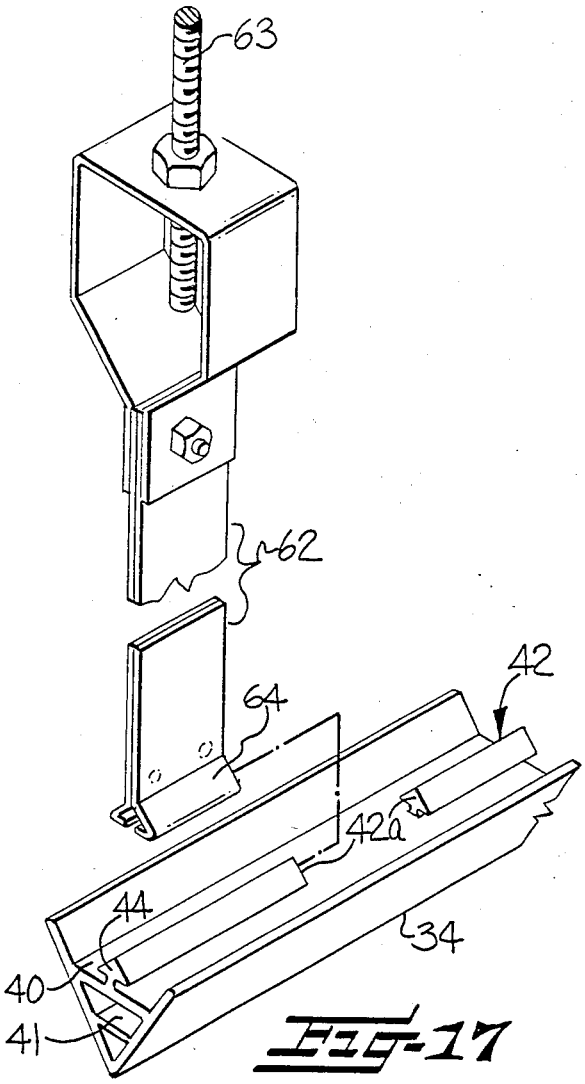
FIG. 17 is an exploded fragmentary perspective view of one of the members of the latticework and a supporting bracket.
Figure 18:
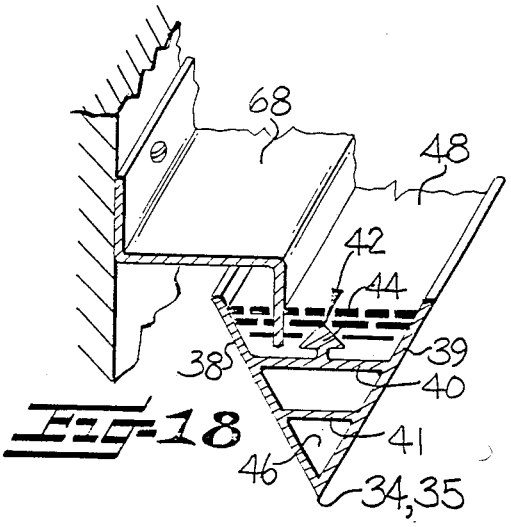
FIG. 18 is a fragmentary sectioned perspective view of the interconnection between a side wall and a peripheral member of the latticework.

FIG. 17 illustrates a support bracket 62, which is adapted to support the ltticework from the top wall 11 of the clean room. More particularly, a number of support brackets 62 are each connected to a threaded tie rod 63, which depend from the top wall 11, and which permit the elevation of each support bracket 62 to be adjusted. Each support bracket 62 includes a triangular receptacle 64 along the lower edge, which is adapted to slide onto the wedge shaped portion 44 of the post 42 of the lengthwise member 34 in the manner best seen in FIG. 17, and thereby support the lengthwise member from the top wall. A portion of the post 42 may be removed as indicated at 42*a* to facilitate the assembly of the receptacle 64 to the post.

To fabricate the above described latticework 30, an L-shaped interconnection 60 is initially installed in each corner of the room, by suspending the interconnection from a support bracket 62 or by any other suitable means. Next, the lengthwise members 34 are installed in a parallel, laterally spaced apart arrangement, with these members also being supported by a number of support brackets 62. The lengthwise members 34 typically have a substantial length, such as about eighteen feet, and depending on the length of the clean room, a number of the members may be joined in an end to end arrangement by the interconnection as shown in FIGS. 12–14. At the four corners, the ends of the members 34 are joined to the aligned ends of the interconnections 60. The end wall members 35 are then mounted along the end walls of the room, and joined to the other ends of the associated interconnections 60.

The cross members 36, which typically have a length of about two feet, may then be installed between adjacent pairs of the lengthwise members 34. A T-shaped interconnection as shown in FIG. 15 is formed between the lengthwise members 34 and the ends of the cross members 36 along two of the side walls of the room, with the assembly being maintained by a retainer 52*b* which is pressed into the posts 42. In this regard, it will also be noted that the end of each cross member 36 is inclined so as to mate with the side wall of the lengthwise member. The remaining ends of the lengthwise members 34 are also joined to the end wall members 35 along the two end walls of the room, to form similar T-shaped interconnections.

The X-shaped interconnections, which are formed at each of the interior corners of the latticework, are formed by bringing the members 36 into position, and joining them by means of the retainer 52*a*, which is also pressed downwardly onto the posts 42 of the members.

As final steps in the fabrication of the latticework, the sealant 48 is deposited upon the upper plates 40 of the interconnected members, and so that the sealant extends continuously about the periphery of each open area 32. In addition, the lengthwise members 34 and end wall members 35 which form the outer periphery of the latticework 30 are sealed to the side walls of the room by means of a Z-shaped plate 68, which has one leg sealed to the wall of the room and the other leg embedded in the sealant 48, note FIGS. 4 and 18.

Figure 19:
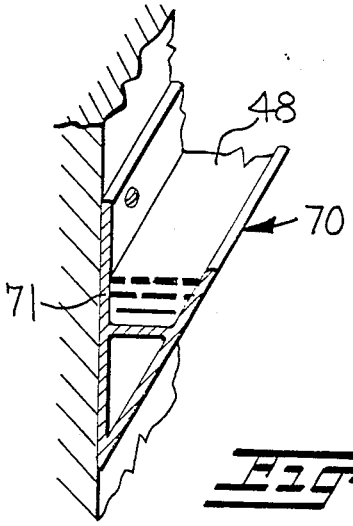
FIG. 19 is a view similar to FIG. 18 but illustrating an alternative embodiment of the side wall interconnection.
Figure 20:
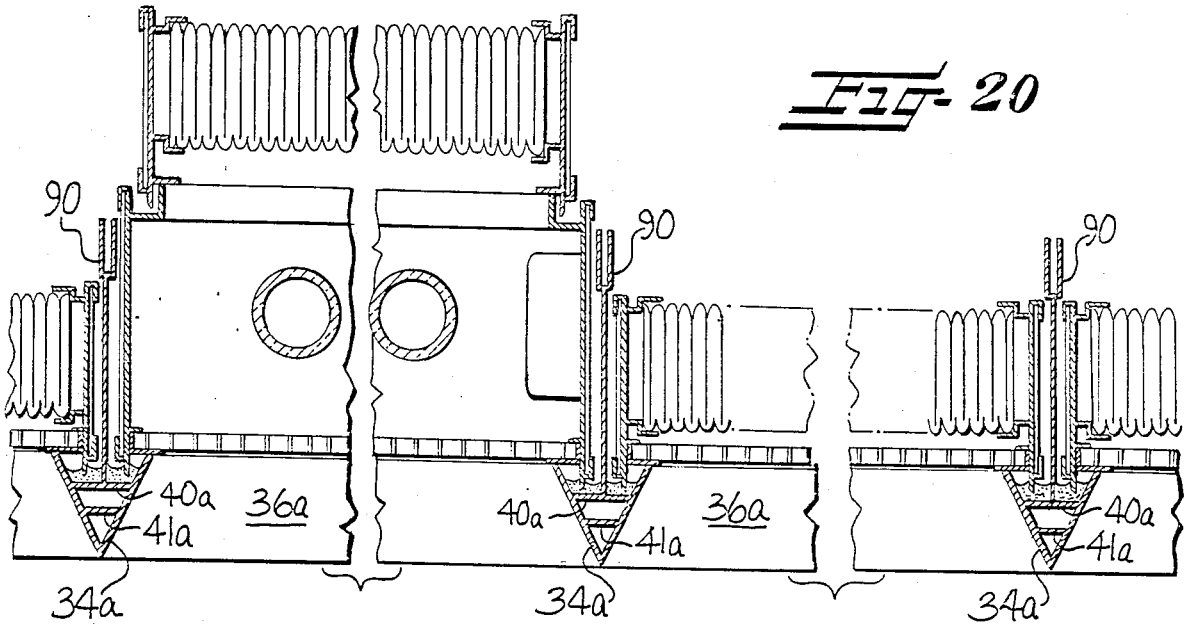
FIG. 20 is a sectional side elevation view of an alternative embodiment of the supporting latticework of the filter bank in accordance with the present invention.

An alternative construction for the lengthwise members 34 and end wall members 35 which form the outer periphery of the latticework is shown at 70 in FIG. 19. In this embodiment, these edge members 70 have a modified cross sectional configuration, which includes a vertical side wall 71 which is adapted to be mounted directly against the side wall of the room, to thereby avoid the need for the Z-shaped plate 68 as described above. As will be understood, the L-shaped corner interconnections would have a corresponding outline.

A plurality of air filters 74 are next positioned on the latticework 30, with one of the filters covering each of the open areas 32. Each filter 74 comprises a rectangular frame 75 which is typically fabricated from an extruded metal or plastic material, and which defines a centrally disposed air flow opening, note FIG. 4. A filter pack 76 is sealably disposed within the air flow opening, and comprises a sheet of filtering medium folded in accordion fashion and with the folds thereof lying substantially parallel to the direction of air flow through the filter. As well known in the art, the sheet of filtering medium may be fabricated from glass, ceramic, or cellulosic fibers, or plastic and polytetraflouroethylene (PTFE), and is designed to remove sub-micron size particles from an airstream at extremely high efficiencies. Filters of this type are generally called "absolute" or "HEPA" filters in the industry.

In the illustrated embodiment, the rectangular frame 75 of each filter 74 comprises four separate side panels which are interconnected in an end-to-end rectangular arrangement and in the manner more fully described in copending and commonly owned application Ser. No. 625,304, filed June 27, 1984, and now U.S. Pat. No. 4,584,005. Each of the side panels includes opposite side edges having outwardly and reversely turned flanges 77 (FIG. 7) which define a pair of opposing channels for receiving a right angled corner plate 73, which interconnects the abutting ends of the adjacent side panels.

The frame 75 also defines a downwardly depending integral peripheral flange or skirt 78 positioned about the outer periphery of the frame 75, the skirt being adapted to rest within the receptacles 47 of the members 34, 35, 36 of the supporting latticework and to be sealably embedded in the sealant 48. A protective plastic "eggcrate" grille 80 may be mounted upon the members to cover each open area, and so that the grille is immediately below the downstream face of each filter. Also, the depending skirt 78 of the frame 75 includes an integral, laterally directed shoulder 81, which is designed to engage and rest upon the grille 80, and thereby effectively limit the depth of penetration of the shirt into the sealant. The depending skirt further includes a knife-like edge 79 which projects downwardly from the outwardly turned flange 77 of the frame, and which extends about the entire periphery of the frame. The knife-like edge 79 thereby assures that the flange 78 penetrates the sealant to achieve a proper seal.

A plurality of lighting fixtures 82 may be positioned in selected open areas 32 of the latticework 30. In the illustrated embodiment, each lighting fixture includes a rectangular metal housing 83 which mounts four fluorescent light bulbs 84, and which includes a downwardly depending lower edge 86 which is sized to rest within the receptacles 47 of the interconnected members of the latticework and be embedded in the sealant 48 about the periphery of the open area. Also, the upper edge of the housing mounts a peripheral channel 87 having a sealant 48 positioned therein. A filter 74 is mounted upon the upper channel 87 of the housing, with the depending skirt 78 of the filter frame sealably embedded in the sealant 48.

As noted above, each of the members 34, 35, and 36 has a corresponding, generally V-shaped outline in cross section, and it is preferred that the angular extent of the V-shaped outline be predetermined so as to provide a substantially laminar flow therealong for the particular value of the air flow rate moving through the clean room. By this arrangement, substantially all of the turbulence below the members of a degree able to entrain dust and dirt particles and move the same laterally through the room, may be substantially eliminated. It will also be seen that the receptacles 47 of the interconnected members of the latticework define a continuous, rectangular, upwardly facing open receptacle which surrounds each of the open areas 32. The sealant 48 is positioned upon the plates 40 and within this peripheral receptacle, and such that the depending metal skirts 78 of the filters, and the corresponding skirts 86 of the lighting fixtures 82, are immersed in the sealant 48 so as to form a non-deteriorating and highly efficient seal therebetween. The shoulder 81 on the skirt of the filters is adapted to engage the plastic grille 80, or alternatively the upper edge of the side wall 38, 39 of the members, to hold the lower edge of the skirt somewhat above the cross plate 40, and thereby prevent the skirt from cutting completely through the sealant 48, which could increase the likelihood of leakage of air.

It is preferred that the sealant 48 comprises an essentially non-volatile and non-hardening moldable gumlike plastic material having a consistency substantially the same as modeling clay. More particularly, the sealant may comprise an uncured dimethyl polysiloxane gum having a viscosity of at least about 500,000 centipoise and a molecular weight of at least about 300,000 a m u.

In one preferred embodiment of the invention, the sealant 48 comprises a compounded uncured dimethyl polysiloxane gum which is sold by the General Electric Company under the product identification SE-32, and which has a specific gravity of about 1.15, volatiles of not more than about 3%, a plasticity of between about 150–170 (Williams), a molecular weight of about 300,000 amu, and a viscosity of about 639,000 centipoise. This gum-like material is readily moldable and has a consistency substantially the same as modeling clay, and it is particularly advantageous in the present invention in that it does not readily flow or leak between the cracks formed between the plates 40 of the adjacent members. Thus caulking or other sealing of these cracks is unnecessary. In certain instances, it has been found desirable to place a thin coating of a silicone base grease, or other petrolatum-like fluid, upon the filter skirts, in order to facilitate the insertion and extraction of the skirts into and from the sealant.

Various fillers may be added to the gum resin to provide desirable properties, such as fire retardancy, heat resistance, or improved tensile strength. As a further non-limiting specific example wherein such fillers are employed, the following composition is suitable for use in fabricating the sealant:

50 parts uncured dimethyl polysiloxane gum (General Electric SE-32)
50 parts uncured methyl vinyl polysiloxane gum (General Electric SE-63)
12 parts fumed silica
5 parts red iron oxide
10 parts decabromodiphenyloxide (Great Lakes (Chemical DE83R)

In the above example, the fumed silica acts to increase tensile strength, the iron oxide increases heat resistance, and the phenyloxide is a fire retardant which permits the sealant to meet UL test standard UL 94 V-O, which requires the sealant to be self-extinguishing when exposed to a flame.

In the embodiment of FIGS. 20–25, the lengthwise members **34*a*, end wall members (not shown), and cross members 36*a* have a somewhat different cross sectional outline as compared to the embodiment of FIGS. 1–19. In particular, the members 34*a* and 36*a* do not include a post 42 as described above, but rather the lengthwise members 34*a* include an integral support bar 90 extending upwardly from the medial portion of the upper plate 40*a* for supporting the latticework from the top wall 11 of the clean room. The two end wall members preferably also include an integral support bar, and are thus identical to the lengthwise members 34*a***.

To connect the members **34*a* and 36*a* at the T-shaped interconnections of the latticework, there is provided an elongate opening 91 through one of the side walls 38*a*, 39*a* of the lengthwise member 34*a* and which communicates with the space formed between the upper and lower plates 40*a*, 41*a*. Also, the opening 91 is vertically aligned with the cut-out sections 61*a* of the side walls. A plate-like retainer 92 is slideably mounted in the space between the upper and lower cross plates at each of the ends of the cross members, and so that each retainer 92 extends outwardly from the associated cross member end. The retainer 92 is thus adapted to extend through the opening 91 in the side wall of the adjacent lengthwise member to interconnect the same. Preferably, the plate 40*a* of each cross member includes a slot 93 adjacent each end, for receipt of a threaded set screw 94** which is received in a threaded bore in the retainer, and which permits the retainer to be locked in its extended position.

The ends of the lengthwise members **34*a*** are joined at an intermediate length of the end wall members (not shown in this embodiment) by a similar T-shaped interconnection which includes an opening in the side wall of the end wall member and a retainer slideably mounted in the end of the lengthwise member so that it may be inserted through the opening of the end wall member.

At the generally X-shaped interconnections as shown in FIGS. 22–24, the lengthwise member 34*a* is provided with aligned openings 91, 91*a* in each side wall, and the retainer 92 extends completely through the two aligned openings of the lengthwise member. Thus each retainer 92 interconnects two of the cross members to the associated lengthwise members.

To fabricate the latticework of the embodiment of FIGS. 20–25, the lengthwise members 34*a* are initially installed in a parallel arrangement, and are supported from the top wall 11 by the integral support bars 90 of the members and tie rods 95. The two end wall members, which preferably also include an integral support bar, are then mounted along the two end walls of the room. Next, the cross members 36*a* are installed by initially withdrawing the retainer 92 into the cross member, inserting the cross member between the two lengthwise members 34*a* and in alignment with the openings 91, 91*a*, and then moving the retainer 92 outwardly by engagement with the set screw 94, and so as to advance its free end through the adjacent opening. The vertically spacing between the upper and lower plates 40*a*, 41*a* of the members closely approximates the thickness of the retainer 92 so as to closely receive the retainer 92 therebetween, and if desired, it may be further held by means of a set screw (not shown) which extends through the plate 40*a* of the lengthwise member to engage the retainer.

The end of the cross member 36*a* opposite the retainer 92 will be subsequently locked in position by the retainer of the aligned cross member, which has a length sufficient to extend through the member 34*a* and enter the slot between the upper and lower plates of the cross member. Here again, a further set screw may be employed to lock the retainer to the opposite end of the cross member, if desired. As will also be apparent, the last cross members to be installed will necessarily slideably mount a retainer 92 at each end, so as to permit interconnection between the two final lengthwise members.

The ends of the lengthwise members 34*a* are joined to the end wall members (not shown) to form a T-shaped interconnection in a manner similar to that described above with respect to the lengthwise and cross members. Also, the four corners of the latticework may be formed by a suitable mitered interconnection between the ends of the lengthwise and end wall members, using an L-shaped outer cover of V-shaped cross section to maintain their assembly in the manner of the cover 53 described above. The latticework is then sealed to the side walls of the clean room, and the receptacles are filled with a sealant 48.

Figure 21:
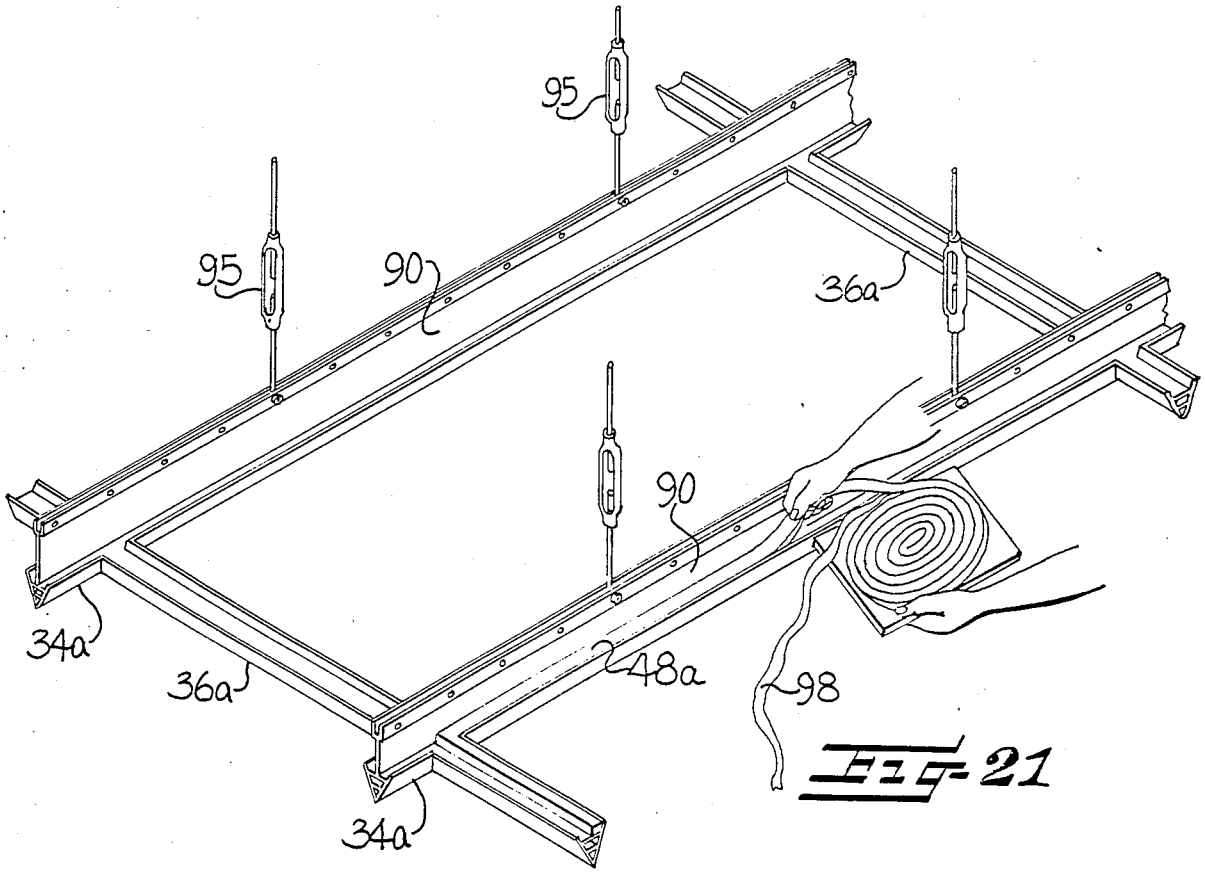
FIG. 21 is a fragmentary perspective view of a portion of the latticework shown in FIG. 20, and further indicating a method for assembling the sealant therein.

To assemble the sealant 48 into the receptacles of the latticework, the sealant may be extruded into an elongate strip 48*a*, which is preferably wound into a flat coil to facilitate handling and storage as seen in FIG. 21. The strip 48*a* includes a sheet of release paper 98 or the like adhered to one side edge of the strip, with the release sheet 98 being disposed between adjacent coils to prevent contact between the adjacent coils. Also, the strip 48*a* is extruded to have a cross sectional shape which generally conforms to the cross sectional shape of that portion of the members above the upper cross plates. The strip 48*a* may be cut into suitable lengths which are progressively disposed along the plates around the periphery of each open area, while the release sheet 98 is stripped therefrom as seen in FIG. 21. The ends of the cut lengths are brought into abutting contact, and the abutting ends of the polysiloxane sealant will in a short time self amalgamate or diffuse into each other, resulting in a continuous uninterrupted joint which has the same appearance and characteristics of the remaining portions of the strip. Thus any possibility of leakage through the joint formed between the abutting ends of the strip is avoided.

In the drawings and specification, there has been set forth preferred embodiments of the invention, and although specific terms are employed, they are used in a generic and descriptive sense only and not for purposes of limitation.

That which is claimed is:

1. A clean room having provision for supplying filtered air vertically therethrough under substantially laminar flow conditions, and comprising a clean room enclosure including a top wall, a bottom wall, and bounding side walls, a filter bank positioned parallel to and spaced below said top wall, said filter bank comprising (a) a supporting latticework composed of a plurality of interconnected members which define a plurality of rectangular open areas, said members of said latticework including a plurality of parallel, laterally spaced apart lengthwise members, and a plurality of cross members extending laterally between the lengthwise members, with said lengthwise and cross members each comprising a pair of outer side walls and an internal plate extending horizontally between the side walls to define an upwardly open receptacle, and with the ends of said cross members abutting said lengthwise members at a location intermediate the ends thereof to define a right angled interconnection therebetween, with each such interconnection including a cut-out section in the side wall of the lengthwise member which extends downwardly to the level of the associated plate and laterally a distance conforming to the separation of the adjacent portion of the side walls of the associated cross member and such that the receptacles and plates of the lengthwise and cross members are coextensive about the periphery of each open area, and with each of said interconnections further including a retainer means interconnecting the end of the cross member and the associated lengthwise member and which includes an opening extending through the side wall of the associated lengthwise member below the associated internal plate, and a retainer extending outwardly from the end of the associated cross member and through said opening, (b) a plurality of high efficiency air filters positioned on said interconnected members of said supporting latticework, with the filters covering respective ones of said open areas, (c) a sealant disposed within the receptacles and upon the coextensive plates of said lengthwise and cross members of said latticework and continuously about the periphery of each open area, and so that the sealant is interposed between said members of said latticework and the periphery of each of said filters to form a seal therebetween, and means for introducing air above each of said filters of said filter bank such taht the air flows downwardly through said filters at a predetermined flow rate.

2. The clean room as defined in claim 1 wherein said sealant comprises an essentially non-volatile and non-hardening moldable gum-like plastic material having a consistency substantially the same as modeling clay.

3. The clean room as defined in claim 1 wherein each of said filters includes a peripheral flange having a continuous cross sectional outline which generally corresponds to the outline of the associated open area, and with a portion of the peripheral flange being positioned within said open receptacle of the associated members of said latticework and sealably embedded in said sealant.

4. The clean room as defined in claim 3 wherein said peripheral flange of each of said filters includes shoulder means fixed thereto for limiting the depth to which the peripheral flange may penetrate said sealant.

5. The clean room as defined in claim 1 further comprising a support member extending upwardly from and fixed to said internal plate of at least some of said members for supporting the latticework in spaced relation below said top wall of said clean room.

6. The clean room as defined in claim 1 wherein said side walls of said lengthwise and cross members are inclined so that the side walls and internal plate have the general form of an inverted A in cross section.

7. A clean room having provision for supplying filtered air vertically therethrough under substantially laminar flow conditions, and comprising a clean room enclosure including a top wall, a bottom wall, and bounding side walls, a filter bank positioned parallel to and spaced below said top wall, said filter bank comprising (a) a supporting latticework composed of a plurality of interconnected members which define a plurality of rectangular open areas, said members of said latticework including a plurality of parallel, laterally spaced apart lengthwise members, and a plurality of cross members extending laterally between the lengthwise members, with said lengthwise and cross members each comprising a pair of outer side walls, an internal plate extending horizontally between the side walls to define an upwardly open receptacle, and a post extending upwardly a relatively short distance from the medial portion of said internal plate and along at least a substantial portion of the length of the member, said post including an upper portion which is wedge shaped in cross section, and with the ends of said cross members abutting said lengthwise members at a location intermediate the ends thereof to define a right angled interconnection therebetween, with each such interconnection including a cut-out section in the side wall of the lengthwise member which extends downwardly to the level of the associated plate and laterally a distance conforming to the separation of the adjacent portion of the side walls of the associated cross member and such that the receptacles and plates of the lengthwise and cross members are coextensive about the periphery of each open area, and each of said interconnections including retainer means grippingly engaging the posts of the associated members to interconnect the same, each of said retainer means comprising a unitary member having an enclosed outline in cross section which includes a longitudinal split bottom wall which is adapted to be spread apart upon the retainer being pressed downwardly onto the wedge shaped upper portion of said post and so as to permit said member to be readily assembled onto the post in a surrounding relationship, (b) a plurality of high efficiency air filters positioned on said interconnected members of said supporting latticework, with the filters covering respective ones of said open areas, and (c) a sealant disposed within the receptacles and upon the coextensive plates of said lengthwise and cross members of said latticework and continuously about the periphery of each open area, and so that the sealant is interposed between said members of said latticework and the periphery of each of said filters to form a seal therebetween, and means for introducing air above each of said filters of said filter bank such that the air flows downwardly through said filters ata a predetermined flow rate.

8. The clean room as defined in claim 7 wherein at least some of said lengthwise members include an and to end interconnection along their length, and wherein each such interconnection includes an elongate retainer grippingly engaging the posts of the associated members to interconnect the members.

9. The clean room as defined in claim 8 wherein said members include a second internal plate extending horizontally between said side walls and below said first mentioned plate, and wherein each such end to end interconnection further includes a second retainer extending longitudinally between the associated members and internally between the two internal plates thereof to further interconnect the members.

10. A clean room having provision for supplying filtered air vertically therethrough under substantially laminar flow conditions, and comprising a clean room enclosure including a top wall, a bottom wall, and bounding side walls, a filter bank positioned parallel to and spaced below said top wall, said filter bank comprising (a) a supporting latticework composed of a plurality of interconnected members which define a plurality of rectangular open areas, said members of said latticework including a plurality of parallel, laterally spaced apart lengthwise members, and a plurality of cross members extending laterally between the lengthwise members, with said lengthwise and cross members each comprising a pair of outer side walls disposed in a generally V-shaped arrangement in cross section and an internal plate extending horizontally between the side walls and such that each member has the general form of an inverted A in cross section, and defines an upwardly open receptacle, and with the lengthwise members and cross members defining a plurality of generally X-shaped interconnections within the interior of the latticework composed of the ends of two aligned cross members abutting an associated lengthwise member at a location intermediate its ends, and wherein each of said generally X-shaped interconnections in the interior of the latticework includes a cut-out section in each of the side walls of the lengthwise member which extends downwardly to the level of the associated plate and laterally a distance conforming to the separation of the adjacent portion of the side walls of the associated cross member and such that the receptacles and plates of the lengthwise and cross members are coextensive about the periphery of each open area, and each of said generally X-shaped interconnections further comprises retainer means interconnecting the associated cross members and lengthwise member, (b) a plurality of high efficiency air filters positioned on said interconnected members of said supporting latticework, with the filters covering respective ones of said open areas, (c) a sealant disposed within the receptacles and upon the coextensive plates of said lengthwise and cross members of said latticework and continuously about the periphery of each open area, and so that the sealant is interposed between said members of said latticework and the periphery of each of said filters to form a seal therebetween, and means for introducing air above each of said filters of said filter bank such that the air flows downwardly through said filters at a predetermined flow rate.

11. The clean room as defined in claim 10 wherein each of said lengthwise and cross members further includes a post extending upwardly a relatively short distance from a medial portion of said plate and longitudinally along at least a substantial portion of the length of such member, and wherein said retainer means at each of said generally X-shaped interconnections comprises a retainer which is grippingly fixed to said posts of the associated lengthwise and cross members.

12. The clean room as defined in claim 11 further comprising a plurality of upwardly extending support brackets which are fixed to said post of at least some of said members for supporting the latticework in spaced relation below said top wall of said clean room.

13. The clean room as defined in claim 12 wherein said post includes an upper portion which is wedge shaped in cross section, and wherein said retainer comprises a unitary member having a generally X-shaped outline, with said unitary member having an enclosed outline in cross section which includes a longitudinally split bottom wall which is adapted to be spread apart upon the retainer being pressed downwardly onto the wedge shaped upper portion of said post and so as to permit the retainer to be readily assembled onto the post in a surrounding relationship.

14. The clean room as defined in claim 10 wherein each of said generally X-shaped interconnections further includes aligned openings extending through each of the side walls of the lengthwise member below the associated plate, and said retainer means comprises a retainer extending between the ends of the associated cross members and below the associated plate, and with the retainer extending through the aligned openings in the side walls of the lengthwise member.

15. The clean room as defined in claim 14 wherein each of said members includes a second internal plate extending horizontally between said side walls and below said first mentioned plate, with said two plates having a vertical separation which closely approximates the thickness of said retainer so as to closely receive the retainer therebetween.

16. A clean room having provision for supplying filtered air vertically therethrough under substantially laminar flow conditions, and comprising a clean room enclosure including a top wall, a bottom wall, and bounding side walls, a filter bank positioned parallel to and spaced below said top wall, said filter bank comprising (a) a supporting latticework composed of a plurality of interconnected members which define a plurality of rectangular open area, said members of said latticework including a plurality of parallel, laterally spaced apart lengthwise members, and a pluraity of cross members extending laterally between the lengthwise members, with said lengthwise and cross members each comprising a pair of outer side walls and an internal plate extending horizontally between the side walls to define an upwardly open receptacle, and with the ends of said cross members aubtting said lengthwise members at a location intermediate the ends thereof to define a right angled interconnection therebetween, with each such interconnection including a cut-out section in the side wall of the lengthwise member which extends downwardly to the level of the associated plate and laterally a distance conforming to the separation of the adjacent portion of the side walls of the associated cross member and such that the receptacles and plates of the lengthwise and cross members are coextensive about the periphery of each open area, and each of said interconnections further including retainer means interconnecting the ends of the cross member and the associated lengthwise member, and wherein the side walls of said lengthwise and cross members are inclined so that the side walls and internal plate have the general form of an inverted A in cross section, (b) a plurality of high efficiency air filters positioned on said interconnected members of said supporting latticework, with the filters covering respective ones of said open areas, (c) a sealant disposed within the receptacles and upon the coextensive plates of said lengthwise and cross members of said latticework and continuously about the periphery of each open area, and so that the sealant is interposed between said members of said latticework and the periphery of each of said filters to form a seal therebetween, and means for introducing air above each of said filters of said filter bank such that the air flows downwardly through said filters at a predetermined flow rate.

* * * * *